United States Patent [19]

Shoff

[11] 4,375,061

[45] Feb. 22, 1983

[54] DIGITALLY DRIVEN AUDIO EFFECTS GENERATOR

[75] Inventor: Daniel J. Shoff, Torrance, Calif.

[73] Assignee: Mattel, Inc., Hawthorne, Calif.

[21] Appl. No.: 220,403

[22] Filed: Dec. 29, 1980

[51] Int. Cl.[3] ..... G08B 27/00

[52] U.S. Cl. ..... 340/384 E; 340/311.1

[58] Field of Search ..... 340/384 R, 384 E, 311, 340/312

[56] References Cited

U.S. PATENT DOCUMENTS 4,237,448 12/1980 Weinberg ..... 340/384 E

FOREIGN PATENT DOCUMENTS 54-114099 9/1979 Japan ..... 340/384 E

OTHER PUBLICATIONS

Elektor, May 1979, vol. 5, No. 5 "Musical Doorbell".

Electronics, Sep. 28, 1978, JSA, vol. 51, No. 20, "Designers Casebook".

E.T.I., Dec. 1980, vol. 9, No. 12, G.B., "Musical Doorbell".

*Primary Examiner*—Harold I. Pitts

*Attorney, Agent, or Firm*—Ronald M. Goldman; Max E. Shirk; Roy A. Ekstrand

[57] ABSTRACT

A digitally driven audio effects generator includes a source of binary information and keyboard which provide digital information to a plurality of source or sink type binary drivers. A ladder matrix is coupled to the binary drivers and provides an output signal. An audio frequency signal generator responds to the keyboard and controls an interrupting switch which serrates the output signal at an audio frequency rate.

10 Claims, 6 Drawing Figures

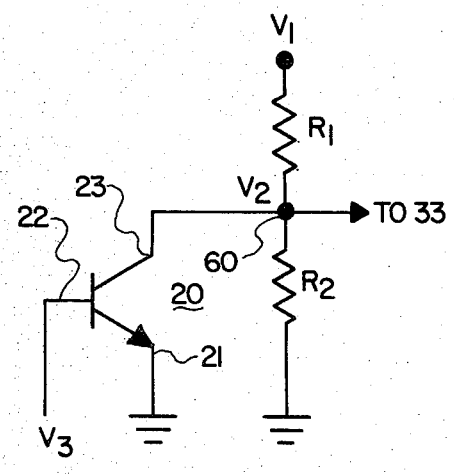
FIG. 2. A.
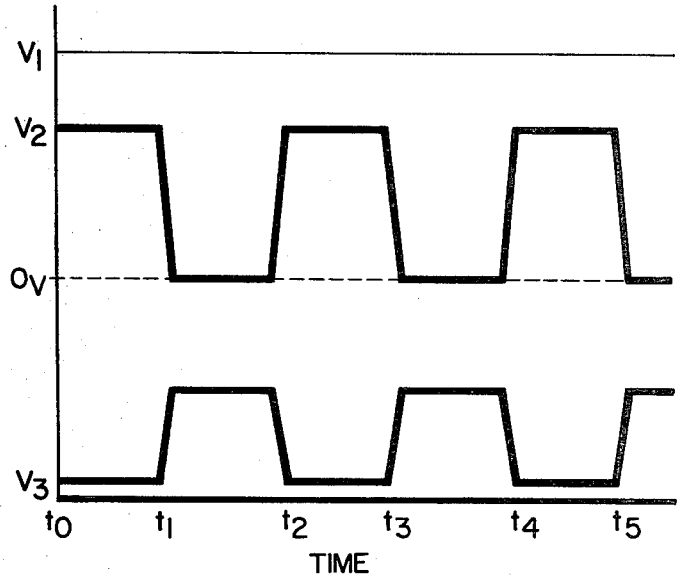
FIG. 2. B
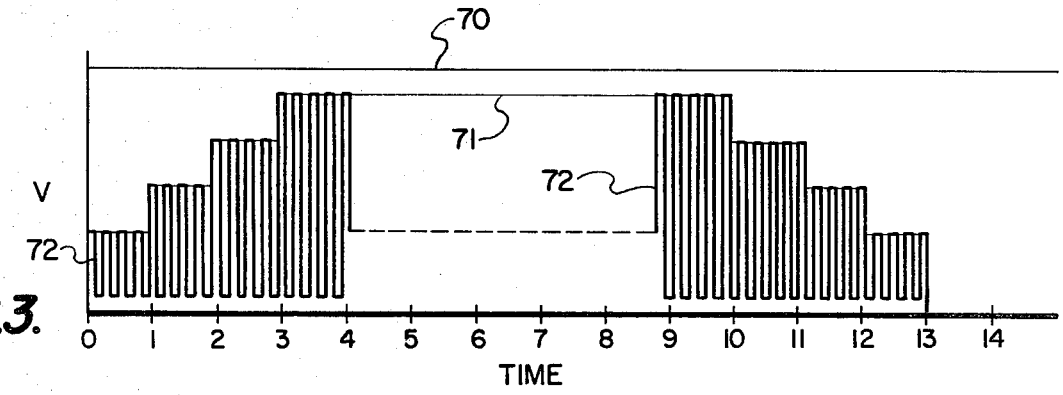
FIG. 3.
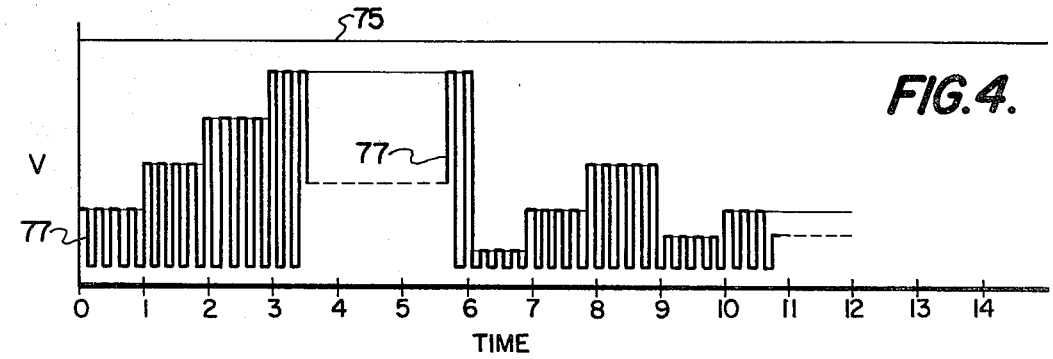
FIG. 4.
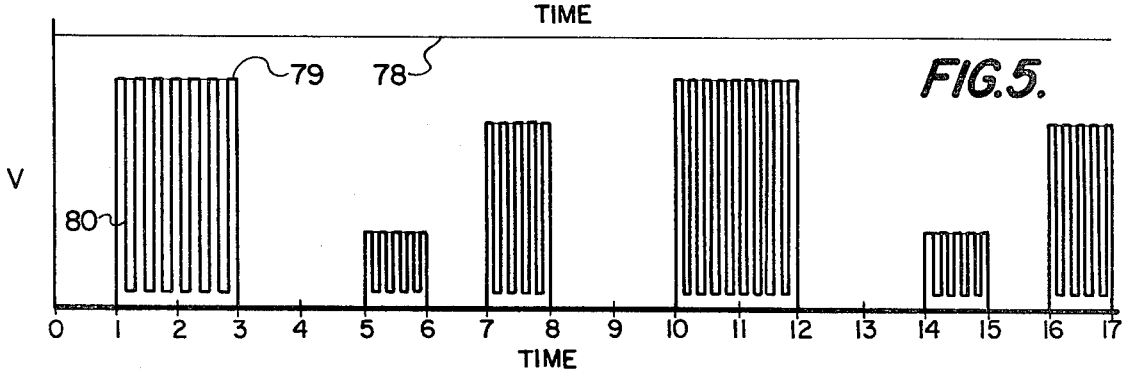
FIG. 5.

DIGITALLY DRIVEN AUDIO EFFECTS GENERATOR

BACKGROUND OF THE INVENTION

This invention relates generally to audio video signal generators and relates particularly to those utilized for music or music tone generation for use in small educational and entertainment devices such as those found in hand-held or desk-top units.

The recent rise in popularity of small electronic hand-held, desk-top, and television player type educational and entertainment devices is well known. In large part this popularity increase occurred as a result of substantial advancements in the semiconductor processing and digital electronic arts whereby the development of the microprocessor circuit evolved. In essence, a microprocessor provides a miniaturized computer capable of performing significant computational and processing routines which can be used in a variety of small, easy to use, and relatively inexpensive low power packages. Initially such devices were relatively low in sophistication. However, as development continued the implimentation of complicated display systems and arrays and challenge in the operation of such devices. In the course of development of devices having greater and greater player and consumer appeal, developers of such educational and entertainment devices included sound generating systems to augment display. Initially these sound systems were nothing more than circuits capable of producing "beeps" of different tones used to indicate success or failure of the player or pupil. However, as the above mentioned sophistication increased, the sound portion of educational routines and game play also increased to a point where educational devices and games which are microprocessor driven frequently include actual music routines and in some instances great effort is exercised to produce a desired character and voice of sound produced in addition to the tonal differences accompanying different notes.

As mentioned, the heart of these educational and entertainment devices is the microprocessor digital electronics system. Therefore, economics mandates that music and tone generators used therein be as compatible with the digital system as possible. The need for digitally driven music producing systems has prompted practioners in the art to design and develop numerous types of sound systems for combination and cooperation with digital electronic systems. While many of the previously developed presently used sound systems provide sufficient tonal flexibility and voice capability to satisfy the teaching and play needs of such educational and entertainment devices, most systems are expensive. The need remains, therefore, for a digitally-driven, low-cost, easy-to-fabricate, audio effects generating system.

OBJECTS OF THE INVENTION

It is therefore a general object of the present invention to provide an improved digitally driven audio effects generator compatible with a microprocessor type system.

It is a more particular object of the present invention to provide an improved digitally driven audio effects generator fabricated with extreme ease and low cost together which provides a reliable and reproducable unit.

SUMMARY OF THE INVENTION

In accordance with the present invention, a digitally driven audio effects generator is provided in which a multi-bit source of digital information indicative of desired amplitude or amplitude variation selected in response to user preference is applied to a plurality of binary drivers each of which have the capability to respond to said digital information and provide a corresponding one of two available voltage states as inputs to a digital-to-analog converter. An audio frequency pulse generator also responsive to user selection is coupled to a switching device operably connected to the digital-to-analog converter in a manner providing the capability to serrate or interrupt the digital-to-analog converter output. As a result the output signal has a frequency determined by the rate of switch operation and an amplitude characteristic corresponding to the digital information applied to the converter.

BRIEF DESCRIPTION OF THE DRAWINGS

The features of the present invention which are believed to be novel are set forth with particularity in the appended claims. The invention together with further objects and advantages thereof may best be understood by reference to the following description taken in conjunction with the accompanying drawings in the several figures of which like reference numerals identify like elements and in which:

FIGS. 2A and 2B set forth an equivalent circuit and waveform depiction of one operating condition of the present invention system.

FIGS. 3 through 5 set forth waveform representations of system operation in response to various examples of keyboard output.

DESCRIPTION OF THE PREFERRED EMBODIMENTS

Figure 1:
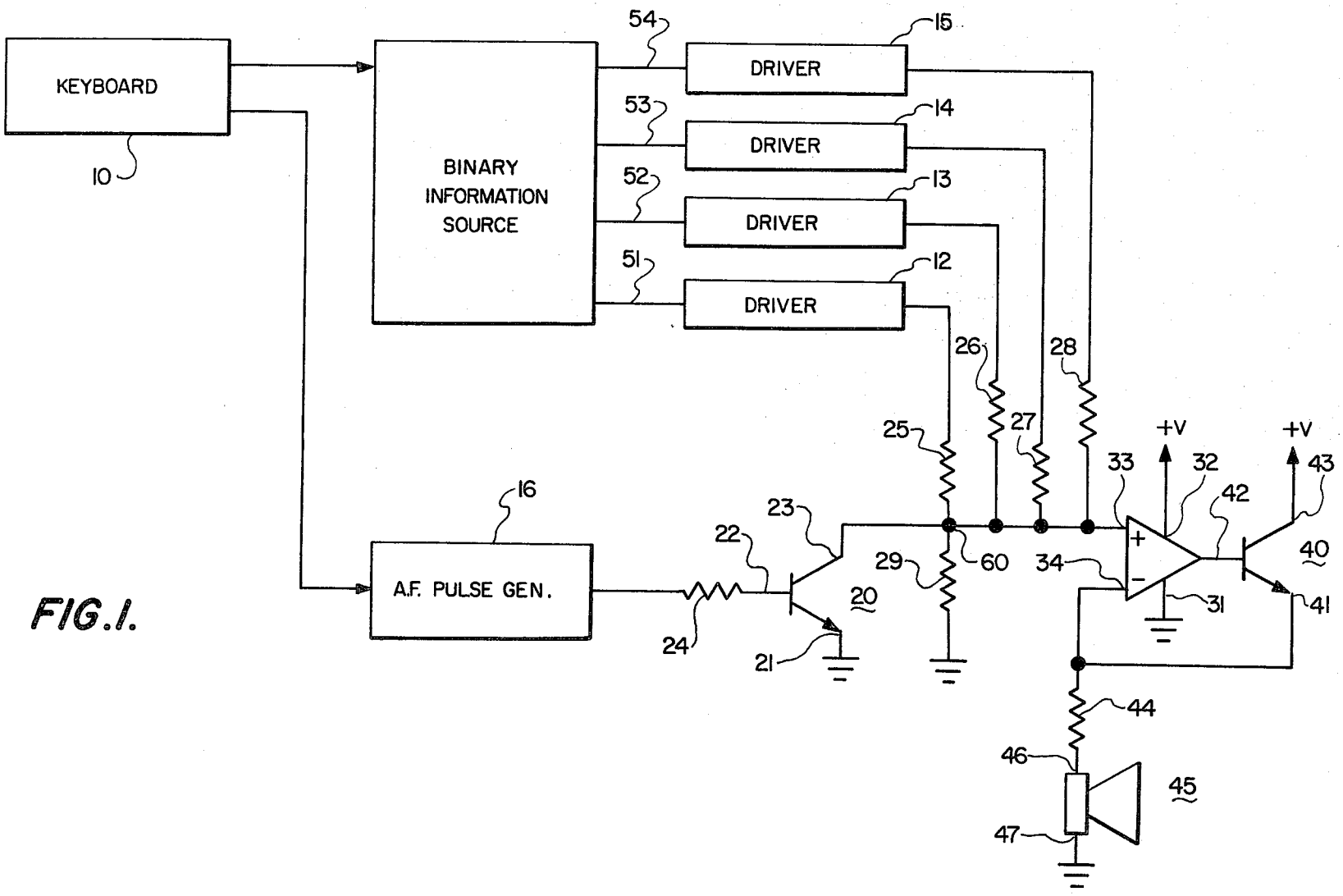
FIG. 1 is a partial block, partial schematic diagram of a digitally driven audio effects generator constructed in accordance with the present invention.

FIG. 1 shows a partial block partial schematic diagram of a digitally driven audio effects generator constructed in accordance with the present invention having a keyboard 10, a binary information source 11, and an audio frequency pulse generator 16. Keyboard 10 includes a plurality of information outputs coupled to binary information source 11 and audio frequency pulse generator 16. A quartet of binary drivers 12, 13, 14 and 15 are coupled by a plurality of digital information connections 51, 52, 53 and 54 to binary source 11. A quartet of matrix resistors 25, 26, 27 and 28 respectively each have one commonly connected to ground through a resistor 29 and the others to output of binary drivers 12 through 15. The common connection of resistors 25 through 29 (node 60) is connected to the non-inverting input of an operational amplifier 30. A transistor 40 has an emitter electrode 41 connected to an emitter resistor 44, a collector electrode 42 connected to the output of operational amplifier 30, and a collector electrode 43 connected to a source of operating voltage (not shown). The inverting input 34 of operational amplifier 30 is connected to emitter 41. Also appropriate connections to ground and to a source of operating potential (not shown) are made by terminals 31 and 30 respectively. A speaker 45 has an input terminal 46 connected to the remaining end of resistor 44 and a ground return electrode 47 connected to ground. A transistor 20 has an emitter electrode 21 connected to ground, a base electrode 22 connected to a base resistor 24, and a collector electrode 23 connected to common node 60. The output of audio frequency pulse generator 16 is connected to the remaining end of resistor 24.

In operation, user selection of one of a plurality of keys (not shown) of keyboard 10 which shall be understood to represent any of the well-known structures in the art in which a combination of user operable keys or buttons provide a plurality of signal outputs in response to user selection, produce a binary-coded output signal which is applied to binary source 11. Binary source 11 contains appropriate circuitry of the type well-known in the art which, in response to a coded output from keyboard 10, assembles a corresponding multi-bit binary number which is available in a parallel mode at output connections 51 through 54. In its simplest form, binary information source 11 might represent a memory device together with an appropriate addressing circuit which in response to keyboard 10 selects the appropriate addressed binary code and applies it to the output terminals. In more complex systems such of those contemplated by the present invention, binary information source 11 comprises a microprocessor unit in which a preprogrammed set of instructions in accordance with well-known methods of processor fabrication responds to keyboard 10 and assembles the desired binary coded output signals for lines 51 through 54.

The binary output signals comprise the well-known binary information in the form of "ones and zeros" which when applied to binary drivers 12 through 15 cause one of two output states to be applied to resistors 25 through 28. In the present embodiment, drivers 12 through 15 are of the variety known in the art as "source and sink" drivers so named because in response to a first binary state they provide an output connection to a supply or source voltage, and in response to the alternate binary state they provide an output connection to a sink or ground. Most commonly, although it represents a matter of design choice, binary drivers 12 through 15 in the present embodiment provide a source or high potential connection in response to a digital "one" input and a sink or ground connection in response to a digital "zero" input. Resistors 25 through 29 comprise a ladder matrix in which the voltage at common node 60 represents some proportion of the voltage source applied to the "top" or higher potential end of ladder resistors 25 through 28. By means described below in greater detail in conjunction with FIGS. 2A and 2B, the binary coded information outputted by binary information source 11 in response to keyboard 10 applied to the quartet of binary drivers 12 through 15 alternatively couples resistors 25 through 28 to supply or ground. So long as the coded binary information persists or remains at the inputs of binary drivers 12 through 15, the appropriate connections and therefore voltages remain applied to resistors 25 through 28. Accordingly, the resulting voltage is then present at node 60.

Simultaneously to user key selection on keyboard 10 which determined the binary code output of binary source 11, a second signal generated by keyboard 10 is applied to an audio frequency pulse generator 16. The structure of audio frequency pulse generator 16 may incorporate any of the well-known regenerative, self-oscilating, or free running circuits known in the art. For example, audio frequency pulse generator 16 may be in simplest form a voltage controlled oscillator which responds to the level of output provided by keyboard 10. Or audio frequency generator 16 may include a plurality of free-running differing frequency multivibrators a selected one of which is keyed on by the selected key of keyboard 10. Regardless of the form selected, the output of sufficient amplitude to provide conduction changes of transistor 20. Transistor 20 is in its preferred form a switching transistor which in response to the output of audio frequency generator 16 provides either an open circuit or low impedance conduction between node 60 and ground. When transistor 20 is on a low impedance connection is opened from node 60 to ground essentially reducing the voltage thereon to a zero or near zero voltage. On the other hand, when transistor 20 is open or turned off, an open circuit or high impedance connection is maintained between node 60 and ground permitting the voltage on node 60 to remain at that level established by the binary coded selection through the actions of binary drivers 12 through 15. Resistor 24 is provided to facilitate the switching operation of transistor 20.

As will be explained below in greater detail, the voltage appearing in response to combined output signals from binary drivers 12 through 15 and audio frequency pulse generator 16 at node 60 comprises a serrated time varying signal the frequency of which is determined by the frequency of audio frequency generator 16 and the amplitude of which is determined by the voltage division of the matrix of resistors 25 through 29. This output signal is applied to the positive or noninverting input of operational amplifier 30 the output of which is applied to a buffer stage comprising transistor 40. Transistor 40 is essentially a common collector or emitter follower stage in which the input signal, applied between base electrode 42 and emitter electrode 41, provides a current gain signal sufficient to drive speaker 45. The latter includes a structure well known in the art whereby the current through an internal coil (not shown) produces an accoustic output. It will be apparent to practioners in the art that the use of a speaker is not pertinent to the present invention but rather any of the wide variety of electro-accoustic transducers such as ceramic units may be used in place of speaker 45 without departing from the spirit of the present invention.

Turning now to an examination of FIGS. 2A and 2B, the details of signal formation in the resistive ladder and switching combination of the present invention are discussed in more detail. As is shown in FIG. 2A an equivalent circuit in which the combination of resistive dividers formed by the switching actions of binary dividers 12 through 15 in cooperation with resistors 25 through 29 is represented by a resistive divider comprising equivalent resistors R1 and R2. R1 represents those resistors of resistors 25 through 28 which in response to a selected code input to binary drivers 12 through 15 are coupled to supply while on the other hand, resistor R2 represents the equivalent of resistors paralleled with resistor 29. It will be apparent to practioners in the art that since there are four matrix resistors 25 through 28 and four binary drivers coupled thereto, that a total of sixteen resistor equivalencies are available. It will be equally apparent to those skilled in the art that a greater or lesser number of resistors and corresponding binary drivers could be selected and utilized without departing from the spirit and scope of the present invention. The operation of resistor switching may best be understood by considering the combinations of resistor equivalencies available. For example, at one extreme is the combination produced in which only one resistor, for example 25, is coupled to supply while the remaining (resistors 26 through 28) are coupled to ground. In that case, the value of equivalent resistor R1 would of course is the resistance of resistor 25 while the value of resistor R2 is the parallel combination equivalent of resistors 26, 27, 28 and 29. At the other extreme is the combination in which all resistors 25 through 28 are coupled to supply leaving only resistor 29 coupled to ground. In that case, the value of equivalent resistor R1 is the parallel equivalent of resistors 25 through 28 and the value of resistor R2 is that of resistor 29.

FIG. 2B shows a group of time-voltage curves depicting a very simple operating condition for the present invention audio effects generator, in which the output of pulse generator 16 is shown as curve V3 which is essentially a square-wave signal having a zero amplitude from time T0 to T1, a positive amplitude from T1 to T2, a return to a zero amplitude from time T2 to T3, and a positive amplitude from T3 to T4. As mentioned above, the combination of digital coded information outputted by binary source 11 causes the application of a predetermined number of matrix resistors to supply potential. This operating potential is designated as voltage V1 (shown in FIG. 2A at the top of the resistive divider formed by equivalent resistors R1 and R2). V1 is also shown for the present example as the upper steady state curve in FIG. 2B. In response to the switching of transistor 20, the conduction path between collector 23 and emitter 21 in parallel with equivalent resistor R2 is alternatively increased and decreased. From time T0 to T1, transistor 20 is nonconductive and the resistance division of equivalent resistors of R1 and R2 causes a voltage V2 porportional to the division according to the familiar formula:

$$V_2 = \frac{R_2}{R_1 + R_2}(V_1)$$

to be established at node 60. Between Time T1 and T2 transistor 20 is turned on and the resulting low impedence path causes a shunting of equivalent resistor R2 which in turn reduces the potential at node 60 to a near zero volt level. Upon the return a nonconducting state of transistor 20 from interval T2, T3 the voltage division between resistors R1 and R2 again established voltage V2 at node 60. This process continues so long as the voltage code corresponding to V2 is applied to binary drivers 12 through 15 and so long as the time varying signal V3 is applied to transistor 20.

While the situation depicted in FIGS. 2A and 2B is a simple one, several important points about circuit function are observable. For instance, it will be apparent to practioners in the art that the extent of signal swing of the voltage at node 60 (i.e. volume) is determined by the values of equivalent resistors R1 and R2. Therefore, a binary code at drivers 12 through 15 which causes V2 to approach V1 produces a large signal output which when coupled to speaker 45 will produce a high volume signal. Conversely, a combination of equivalent resistors R1 and R2 in response to a different binary code applied to drivers 12 and 15 which causes V2 to produce a low voltage at node 60 and thereby a smaller amplitude signal will result in a lower volume output for speaker 45. In addition, it is apparent from examination of FIGS. 2A and 2B that the rate at which the signal applied to base 22 of transistor 20 switches the transistor, determines the rate at which the output signal at node 60 varies with time. Accordingly, a faster or higher frequency switching of transistor 20 produces a correspondingly higher frequency or pitch output signal while a slower or lower frequency switching of transistor 20 results in a lower frequency of lower pitch output signal.

It is believed that the essentials of circuit operation of the present invention digitally driven audio effects generator can be fully understood by practioners in the art through the examination of FIGS. 1, 2A and 2B and the foregoing discussions however, in order to better demonstrate the system's flexibility and the wide-ranged possibilities of signals which can readily be produced by the present invention system, FIGS. 3 through 5 set forth diagrams similar to FIG. 2B showing the waveforms of several sample effects.

FIGS. 3 through 5 are similar in that each sets forth a trio of waveforms in which time is displayed on the horizontal axis and voltage is displayed on the vertical axis. Further, each shows an envelope curve which represents the amplitude variations occuring in voltage at node 60 in response to changes in the binary information code applied to binary drivers 12 through 15 and the output signal showing the time varying or serrated signal.

Turning specifically to FIG. 3, there is depicted therein a audio effect corresponding to a simple "beep" in which a constant frequency signal is caused to initially increase in volume, then maintain a substantially constant volume for a predetermined period of time and finally decrease in volume at a predetermined rate. More specifically, a plurality of time intervals which for simplicity are shown equally spaced 1 through 13 are shown on the horizontal time axis. During each of these time intervals the desired output signal volume level is produced by providing the corresponding binary information code which configures the resistive ladder in the appropriate manner to divide the supply. As shown in FIG. 3, the curve 71 which forms the envelope of the voltage at node 60 is successively increased during intervals 1, 2 and 3 and is maintained substantially constant from time 3 until time 10 when it is decreased successively during the time intervals 10 to 13. Curve 72 which represents the output signal at node 60 is serrated or varied between the amplitude defined by envelope 71 and a near zero level determined by the saturation of transistor 20. As mentioned above, the frequency at which curve 72 is varied or serrated determines the frequency of the output signal. Accordingly it can readily be seen that the output signal resulting from the conditions shown in FIG. 3 is that of a constant frequency signal having an amplitude which first increases in volume then remains substantially constant for some time and then decreases in volume.

FIG. 4 shows the curves for a audio program in which the effect of reverberation or "echoing" is desired. In this instance envelope voltage curve 76 which is determined by the resistive matrix is caused to increase by successive binary output signals in a substantially constant manner from time 0 to time 3 and then is maintained at a substantially constant value from time 3 until time 6 whereupon the output level is decreased rapidly and then increased slightly from time 6 to time 8 only to decrease again at time 9 and return to a lower level at time 10. Again, this envelope is serrated or varied in amplitude by the switching action of transistor 20 whereby a serrated time varying curve 77 having an amplitude envelope corresponding to curve 76 is produced. In similarity to the situation set forth above in FIG. 3, the frequency of signal, or pitch, is determined by the frequency of serrations in curve 77 while the volume or loudness of the signal is determined by the amplitude corresponding to envelope 76. Examination of curves 77 and 76 in FIG. 4 readily shows that a reverberation type signal is produced upon application to the speaker. In other words, a constant pitch signal which increases in volume, decreases and is then followed by lower amplitude echos at intervals 8, 9 and 10 results.

FIG. 5 sets forth a third sample set of curves in which a rhythm type audio effect is produced in this instance, envelope 79 is that of a signal produced by sharp, abrupt changes in the voltage at node 60. In this instance, at time 1 an abrupt increase in voltage at node 60 is maintained for two time intervals until time 3 and then sharply decreased only to return to a lesser amplitude abruptly for time 5 through time 6 and then to decrease sharply again to return to an intermediate amplitude at time 7 which is maintained at time 8. As shown in previous curves serrated curve 80 depicts the serations or time variances of the envelope signal 79 which determines by its frequency the pitch of the tone produced.

It will be readily apparent to those skilled in the art that the above-described inventive system provides a system whereby many of the most complex of audio effects can be produced in a relatively inexpensive system. It will be equally apparent to those skilled in the art that the intervals during which changes in the volume of signal are produced correspond to the intervals of time in which binary information source recycles or reconfigures its binary output code.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A digitally driven audio effects generator comprising:

a source of binary information, providing a binary encoded output signal indicative of a selected amplitude characteristic;

a source of operating potential;

a source of audio frequency signal;

digital to analog conversion means having means for receiving digitally encoded information and means for producing an analog output signal having an amplitude corresponding to said digitally encoded information;

means coupling said source of binary information to said digital to analog conversion means; and switching means, coupled to said source of audio frequency signal and to said digital to analog conversion means, interrupting said output signal at a rate determined by the frequency of said audio frequency signal.

2. A digitally driven audio effects generator as set forth in claim 1 further including an electro-acoustic transducer coupled to said digital to analog conversion means.

3. A digitally driven audio effects generator as set forth in claim 2 wherein said digital to analog conversion means includes a plurality of resistors each having a first and a second terminal wherein said first terminals are coupled to a common node and wherein said means coupling include:

a plurality of binary drivers, each having an input and output terminal, producing an output signal having one of two selected, potentials in as a function of the binary state applied to said input terminal.

4. A digitally driven audio effects generator as set forth in claim 3 wherein one of said second terminals of one of said resistors is connected to ground and wherein said second terminals of said remaining resistors are each connected to a selected one of said output terminals of said binary drivers.

5. A digitally driven audio effects generator as set forth in claim 4 wherein said switching means includes a transistor.

6. A digitally driven audio effects generator as set forth in claim 5 wherein said transistor includes an emitter electrode coupled to ground, a base electrode coupled to said source of audio frequency signal, and a collector electrode coupled to said source of operating potential.

7. A digitally driven audio effects generator as set forth in claim 6 wherein said source of binary information includes a keyboard.

8. A digitally driven audio effects generator as set forth in claim 7 wherein said electro-acoustic transducer includes a speaker.

9. For use in an educational and entertainment device including a digital electronic systems in which a plurality of audio effects are to be produced in response to user command digitally controlled audio effect means comprising:

a keyboard having a plurality of operable keys;

a source of binary information coupled to said keyboard and having at least two output terminals including processor means having a stored code of instructions for supplying a binary code amplitude control signal by imposing either of two binary logic states upon said terminals in a parallel bit mode;

a resistive ladder matrix having a plurality of matrix resistors corresponding to said output terminals each coupled between one of said output terminals and a common node and a resistor coupled between said common node and ground;

a source of audio frequency signal coupled to said keyboard and producing an audio frequency signal responsive to said keys having a frequency corresponding to the selected one of said keys depressed; and a transistor having a first electrode coupled to said source of audio frequency signal, a second electrode coupled to ground, and a third electrode coupled to said common node operative in response to said audio frequency signal to alter the volume at said common node.

10. Digitally controlled audio effect means as set forth in claim 9 wherein said source of binary includes four output terminals and means providing thereon four bit parallel shifted binary information, and wherein said plurality of matrix resistors numbers four.

* * * * *